United States Patent [19]

Morikawa et al.

[11] Patent Number: 5,029,315

[45] Date of Patent: Jul. 2, 1991

[54] COPYING APPARATUS AND COPYING METHOD

[75] Inventors: Takeshi Morikawa; Tsuneo Kitagawa, both of Osaka, Japan

[73] Assignee: Minolta Camera Kabushiki Kaisha, Osaka, Japan

[21] Appl. No.: 440,297

[22] Filed: Nov. 22, 1989

[30] Foreign Application Priority Data

Nov. 25, 1988 [JP] Japan ..... 63-298583

[51] Int. Cl.[5] ..... G03G 15/28

[52] U.S. Cl. ..... 355/235; 355/313

[58] Field of Search ..... 355/233, 235, 313, 208, 355/243

[56] References Cited

U.S. PATENT DOCUMENTS

| | | | |
|---|---|---|---|
| 4,029,409 | 6/1977 | Spinelli et al. | 355/233 X |
| 4,057,341 | 11/1977 | Sohm . | |
| 4,090,787 | 5/1978 | Hubbard | 335/233 X |
| 4,417,806 | 11/1983 | Tani et al. . | |
| 4,547,062 | 10/1985 | Fujiwara et al. | 335/206 X |
| 4,685,796 | 8/1987 | Shimizu et al. . | |
| 4,690,545 | 9/1987 | Maehara | 355/233 X |
| 4,708,486 | 11/1987 | Watanabe | 355/233 X |
| 4,771,317 | 9/1988 | Katoh et al. | 355/233 |
| 4,783,682 | 11/1988 | Maehara | 355/233 X |

*Primary Examiner*—R. L. Moses

*Attorney, Agent, or Firm*—Burns, Doane, Swecker & Mathis

[57] ABSTRACT

A copying apparatus operating either in a first image scan mode wherein a scan of an original at a standstill on an original table is performed by the movement of an optical system and the image is projected onto a photosensitive member, or in a second image scan mode wherein the optical system standing by a specified position scans an original being transported by an original transport unit and the image is projected onto the photosensitive member. Distance between a position where the optical system actually stops and a standard position where the optical system is supposed to stop is measured, and in an operation in the second image scan mode, the transport of an original and the supply of a copy sheet are adjusted in order to be synchronized with each other, according to the measured distance.

9 Claims, 7 Drawing Sheets

COPYING APPARATUS AND COPYING METHOD

BACKGROUND OF THE INVENTI0N

1. Field of the Invention

The present invention relates to a copying apparatus and a copying method, and more specifically, a copying apparatus and a copying method for copying an original image onto a copy sheet in the electrophotographic method.

2. Description of Related Art

Generally, in an electrophotographic copying machine, an original is scanned and exposed to light by the movement of an optical system, and it is necessary to change originals on an original glass one by one. In order to omit this troublesome operation, the changing of originals and to improve the efficiency of such a copying machine, various types of automatic document feeders (which is hereinafter referred to as ADF) have been developed. An original-moved scanning type of ADF wherein an original is scanned by an optical system standing by at a scan starting position while being transported at a fixed speed so that the image is projected onto a photosensitive drum has been suggested as type of ADF.

Incidentally, in the original-moved scanning type of ADF, the transport of an original by the ADF to a position where the original is exposed to light from an optical system needs to be synchronized with the supply of a copy sheet to a transfer section so that the leading edge of the image formed on the photosensitive drum agrees with the leading edge of the copy sheet. However, when the optical system returns to a scan starting position in an ordinary image exposure operation, it never returns exactly to the scan starting position and comes to a standstill, slightly overrunning the position. Further, the overrun distance is different from scan to scan. If a copying operation is performed using the ADF regardless of the overrun distance, an image is copied onto a copy sheet, lagging in the direction of the travel of copy sheets according to the overrun distance.

Conventionally, the different positions where the optical system comes to a standstill in every scan are measured by exclusive detection means, and based on the measured value, the transport of an original and the supply of a copy sheet are adjusted in order to synchronize them. In this way, however, the installation of the exclusive detection means is costly, and the regulation is complicated.

SUMMARY OF THE INVENTION

It is, therefore, an object of the present invention to provide a copying apparatus comprising an original-moved scanning type of ADF wherein different stop positions of an optical system in returning toward a specified position are detected and measured by a simple mechanism, and the transport of an original by the ADF and the supply of a copy sheet are adjusted properly to synchronize them so that a gap between the original image and a copy image is prevented.

To attain the above object, a copying apparatus according to the present invention comprises an original table for supporting an original; optical means for scanning the original on the original table and projecting the image onto a photosensitive member; drive means for moving the optical means; means for transporting the original in one direction on the original table; control means for operating the optical means and the original transport means either in a first image scan mode wherein a scan of an original at a standstill on the original table is performed by the movement of the optical means and the image is projected onto the photosensitive member, or in a second image scan mode wherein the optical means standing by at a specified position scans an original being transported by the original transport means and the image Is projected onto the photosensitive member; means for measuring distance between a position where the optical means actually stops and the specified position where said optical means is supposed to stop; and means for adjusting the transport of an original and the supply of a copy sheet to synchronize them according to the distance measured by the measuring means in an operation in the second image scan mode.

It is preferable to utilize a switch for detecting the optical means reaching the standard position and an encoder provided for the drive means for the optical means as the measuring means. In returning toward the standard position after a preliminary scan at the time of starting the power supply, or after a scan in the first image scan mode, the optical means overruns the standard position detecting switch and stops. The overrun distance is calculated by a computer based on a count of pulses generated from the encoder. According to the value (overrun distance), the transport of an original and the supply of a copy sheet are adjusted. For example, the timing of supplying the copy sheet to a transfer section is delayed for a time corresponding to the measured value.

In a copying apparatus according to the invention above, a gap between an image on the photosensitive drum and a copy image on a sheet, which is caused by different stop positions where the optical means returns, is adjusted properly by a simple mechanism utilizing the switch for detecting the optical means reaching the standard position.

Further, a copying apparatus according to the present invention, comprises not only the elements above but also an original tray for holding originals; means for taking the originals out of the original tray one by one automatically and transporting each original in one direction on the original table; means for detecting the originals set on the original tray; and means for setting the second image scan mode and settling copying conditions to specified ones when the originals on the original tray are detected by the detecting means. The copying conditions includes the number of copy sets and/or the magnification, and the number of copy sets and the magnification rate are both set to "1".

According to the invention above, when the second image scan mode is designated, the number of copy sets and the magnification are automatically set to ones required for the copying operation, which contributes to the simplification of key operation and the prevention of miscopying.

Furthermore, a copying method according to the present invention relates to a method of preventing a gap between an original image and a copied image in performing an original-moved scan by the above-described copying apparatus and comprises the following steps: a step of moving optical means along an original table; a step of stopping the optical means at a specified position after the movement; a step of detecting a position where the optical means actually comes to a standstill; a step of performing a scan of an original being transported by original transport means in one direction by the optical means which is at a standstill so that the image is projected onto a photosensitive member; and a step of transporting a copy sheet at a specified timing according to the detected position where the optical means comes to a standstill.

BRIEF DESCRIPTION OF THE DRAWINGS

These and other objects and features of the present invention will become apparent from the following description taken in conjunction with the preferred embodiment thereof with reference to the accompanying drawings.

The drawings show an embodiment of a copying apparatus according to the present invention.

FIGS. *6a* and *6b* are flowcharts showing a subroutine for transporting a copy sheet.

DETAILED DESCRIPTION OF THE PREFERRED EMBODIMENT

An embodiment of a copying apparatus according to the present invention is hereinafter described, referring to the accompanying drawings.

Constitution and Operation of the Copying Apparatus

Figure 1:
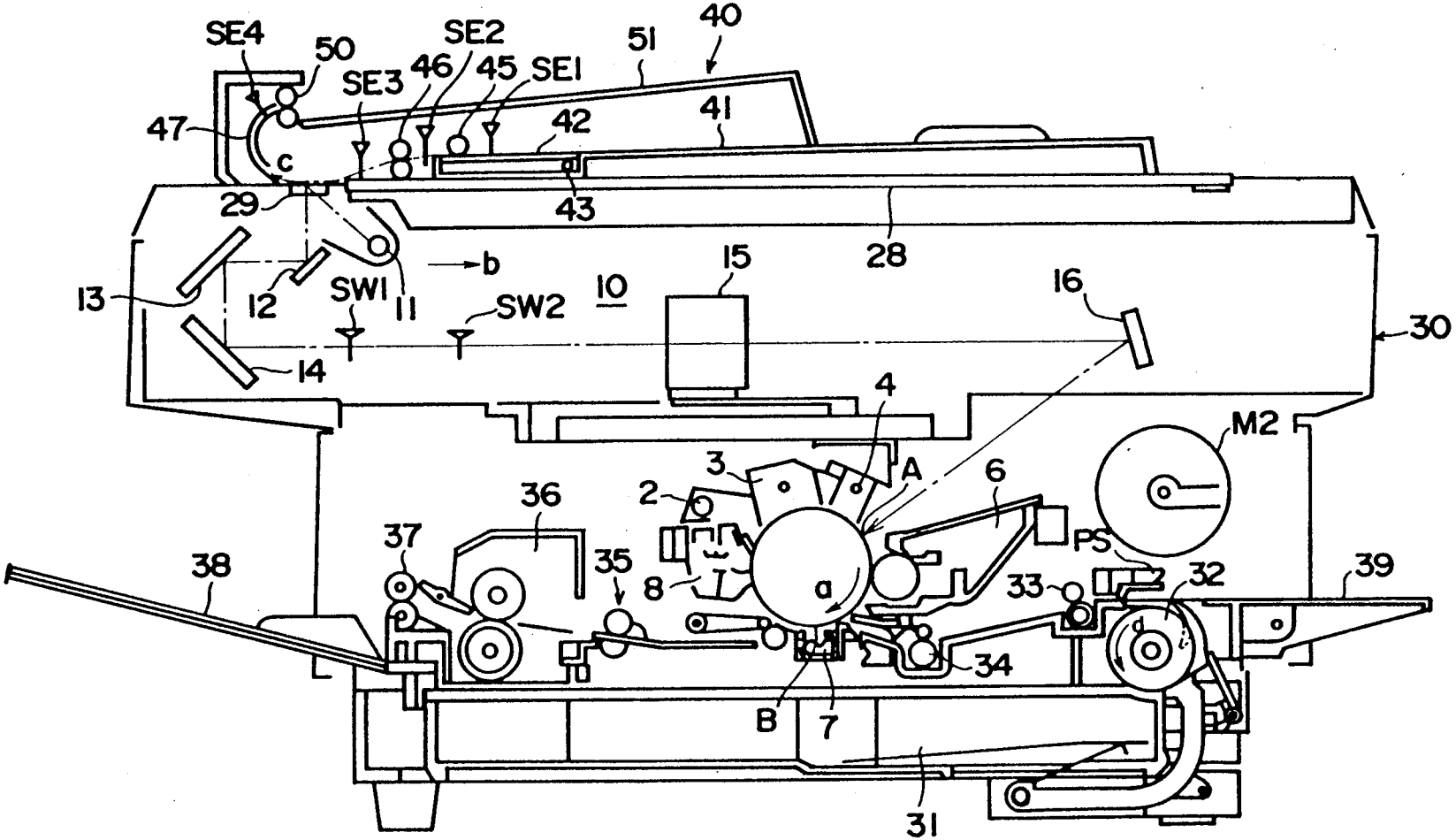
FIG. 1 is a view showing the general constitution of the apparatus.

In reference to FIG. 1, a photosensitive drum 1 which can rotate in the direction of the arrow a is arranged in the center portion of a body 30 of the copying apparatus. Around the photosensitive drum 1, a main eraser lamp 2, an electric charger 3, an image end/space eraser 4, a developing device 6, a transfer charger 7, a cleaning device 8, etc. are arranged in order. The photosensitive drum 1 has a photoconductive layer on the surface. The photoconductive layer is evenly charged while passing through the main eraser lamp 2 and the electric charger 3, and it is exposed to light radiated from an optical system 10 at an exposure point A, so that an electrostatic latent image is formed thereon. The image end/space eraser 4 removes unnecessary charge from the surface of the photosensitive drum 1 when the latent image is formed thereon.

Figure 2:
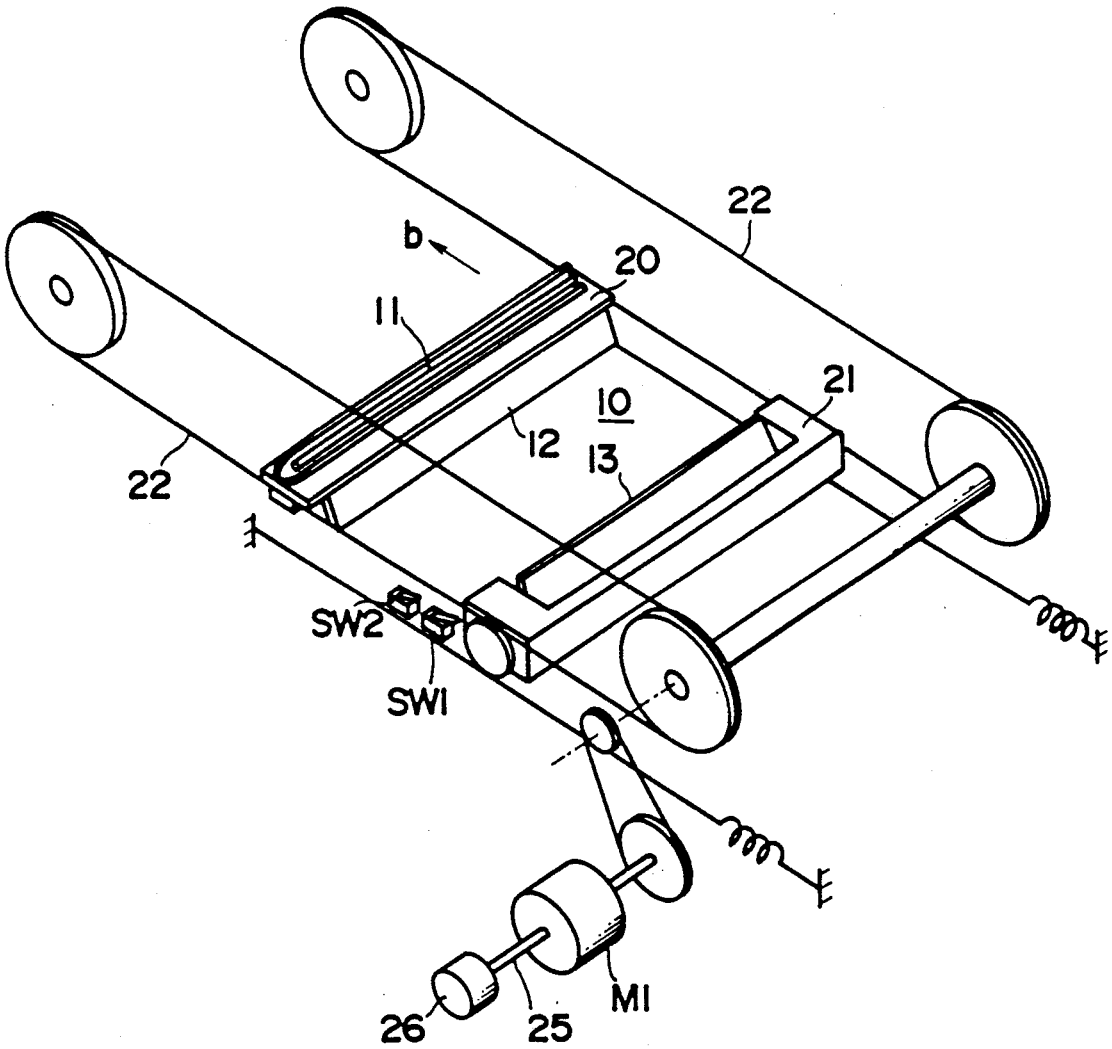
FIG. 2 is a perspective view showing a drive mechanism of an optical system.

The optical system 10 is disposed under an original glass 28 to scan an original on the glass 28, and it comprises an exposure lamp 11, movable mirrors 12, 13, 14, a lens 15 and a mirror 16. As shown in FIG. 2, the exposure lamp 11 and the movable mirror 12 are fitted to a first slide 20, and if the circumferential speed of the photosensitive drum 1, that is, a system speed v is fixed regardless with magnification, they are movable in the direction of the arrow b at a speed of v/m (m: a magnification rate). The movable mirrors 13 and 14 are fitted to a second slide 21, and they are movable in the direction of the arrow b at a speed of v/2m. The first and the second slides 20 and 21 are driven by a DC motor M1 via wires 22. The ordinary copying operation mode wherein a scan of an original placed on the original glass 28 is performed by the movement of the optical system 10 in the direction of the arrow b so that the image is projected onto the photosensitive drum 1 is hereinafter called a first image scan mode.

Incidentally, an encoder 26 is fitted to the output shaft 25 of the DC motor M1, and the rotation of the motor M1 is indicated as a pulse signal. Accordingly, by detecting the frequency of the encoder pulses, the position and the speed of the optical system 10 are measured.

The optical system 10 stands by at a scan starting position as shown by the solid line in FIG. 1. At the position, it irradiates an original glass strip 29 to scan an original being moved on the original glass strip 29 in the direction of the arrow c by an original-moved scanning type of ADF 40, which will be described later, so that the image is projected onto the photosensitive drum 1 at the exposure point A. The copying operation mode using the ADF 40 is hereinafter called a second image scan mode or an ADF mode.

Further, in this embodiment, switches SW1 and SW2 in reference to the movement of the optical system 10 are disposed. These switches SW1 and SW2 are turned on or off when they come into contact with the first slide 20. The switch SW1 detects whether the optical system 10 is returned to a standard scan starting position or not. The switch SW2 is a reference to generate a timing signal for taking the timing of supplying a copy sheet to the photosensitive drum 1 in the first image scan mode.

Copy sheets are stored in a removable automatic feed cassette 31 which is fastened to the body 30 at the lower portion. The sheets are fed along the circumference of a feed roller 32 into the body 30 one by one by the rotation of the feed roller 32 in the direction of the arrow d. A copy sheet fed out of the cassette 31 is transported to a pair of timing rollers 34 through a pair of intermediate rollers 33, and the sheet once comes to a standstill, the leading edge being in contact with the timing rollers 34. During an operation in the first image scan mode, when the switch SW2 is turned on by the movement of the optical system 10 in the direction of the arrow b, and accordingly a timing signal is generated, the sheet is fed to a transfer point B in synchronization with the image formed on the photosensitive drum 1. Then, a toner image is transferred on the sheet. The timing of releasing the copy sheet from the register (the timing of turning on the pair of timing rollers 34) during an operation in the second image scan mode will be described later. The copied sheet is peeled off the photosensitive drum 1. The sheet passes through an ejection/transport section 35 comprising a transport belt, rollers, etc. and transported to a fixing device 36 where the toner image is fixed on the sheet. Thereafter, the sheet is ejected onto a tray 38 through ejection rollers 37.

Rotating members in the body 30 such as the photosensitive drum 1, the feed roller 32, the pair of timing rollers 34 and so on are driven by the main motor M2. The driving force is transmitted to each member by a clutch provided with a solenoid. The clutch is operated in response to an on/off control signal toward the solenoid. Also, it is possible to feed copy sheets from a feed table 39 one by one manually. In both cases of the automatic feeding and the manual feeding, the presence of sheets to be fed is detected by a paper sensor PS.

Constitution and Operation of the ADF

The ADF 40 is an original-moved scanning type wherein originals are fed one by one, and one copy is made for each original. It comprises an original table 41 disposed on the original glass 28, an original feed roller 45 for feeding originals from the original table 41, a pair of original timing rollers 46 for feeding the originals onto the original glass strip 29, a guide plate 47, a pair of ejection rollers 50 and a tray 51. The original table 41 has a press-up plate 42 which is pivoted up and down on a shaft 43. Originals are placed on the original table 41 with the faces down, and the presence of the originals is detected by a sensor SE1. Also, sensors SE2, SE3 and SE4 are installed in the path of originals. Each of the sensors SE1 through SE4 is turned on and off respectively when the leading edge of an original reaches it and when the trailing edge of the original passes it.

Further, the ADF 40 can be open and closed freely so that the original glass 28 can be exposed in a state that it is mounted on the body 30. The original table 41 functions as an ordinary original cover. The body 30 and the ADF 40 are provided with magnet and a reed switch respectively. When the ADF 40 is closed, the reed switch is turned on because of the magnet, and the ADF 40 is pulled open, the reed switch is turned off. When the ADF 40 is closed, and the reed switch is on, the sensor SE1 detects that originals are set on the original table 41. Then, when a print key on a control panel is turned on, the press-up plate 42 is moved upward to press the originals against the feed roller 45. At the same time, the feed roller 45 is driven to rotate, and the uppermost original is fed in the direction of the arrow c. The leading edge of the fed original is detected by the sensor SE2 and when a predetermined time passes after that, the feed roller 45 is stopped rotating. In this moment, the original comes to a standstill, the leading edge contacting with the pair of timing rollers 46, and the original stands by, being made into a small loop. When a copy sheet fed from the cassette 31 is detected reaching the copy sheet timing rollers 34, the original timing rollers 46 are driven to rotate, so that the original is fed onto the original glass strip 29. The leading edge of the fed original is detected by the sensor SE3, and when a predetermined time (which can be changed and will be described later) passes after that, the copy sheet timing rollers 34 are driven to rotate, and the copy sheet is fed to the transfer point B. The original passing the original glass strip 29 is exposed to light from the exposure lamp 11 of the optical system 10 which is positioned in a scan starting position. The image is projected onto the photosensitive drum 1 at the exposure point A. Thereafter, the original is ejected onto the tray 51 through the ejection rollers 50, and when the trailing edge of the original is detected by the sensor SE4, transport of one original is completed.

Making one copy for one original using the ADF 40 is the second image scan mode. In order to simplify the constitution and handling of the ADF 40, when it is detected by the sensor SE1 that originals are set on the original table 41, the operation mode is changed to the second image scan mode (ADF mode) automatically, and at the same time, the number of copy sets and the magnification are both designated "1" automatically.

Adjustment of an Error of the Stop Position of the Optical System

A moving type of optical system 10 as shown in FIG. 2 never returns exactly to the standard scan starting position, and it overruns slightly and stops. To speed up the copying operation, the optical system 10 is generally returned at a speed more than twice of the system speed Vp, and when the first slide 20 comes to the switch SW1, which detects the optical system 10 at the standard scan starting position, the switch SW1 is turned on, and the brake is applied. However, even after the brake is applied, the optical system 10 still moves a few millimeters more because of the inertia of the motor M1. Even in a way of applying the brake previously, since the stopping operation is performed based on the turning-on of the switch SW1, an error occurs because of the difference between the detecting point of the switch SW1 and the stop position of the optical system 10.

The error is measured based on a pulse signal generated from the encoder 26, which is fitted to the output shaft 25 of the DC motor M1, in proportion to the rotating speed of the motor M1. The travel of the optical system 10 per pulse of the encoder 26 is determined by the number of encoder pulses per rotation, the reduction rate of a speed reducing gear and the radius of a driving pulley. Accordingly, the travel of the optical system 10 after turning on the switch SW1 can be calculated by counting the encoder pulses.

In the second image scan mode, a lag occurs between the timing of feeding an original and the timing of supplying a copy sheet, and the timings have to be adjusted according to the travel of the optical system 10 in order to cause the leading edge of the image on the photosensitive drum 1 to coincide with the leading edge of the copy sheet at the transfer point B. In this embodiment, considering the easiness, the timing of releasing a copy sheet from the register, that is, the timing of turning on the timing rollers 34 is adjusted.

This adjustment is performed in the following way.

Figure 3:
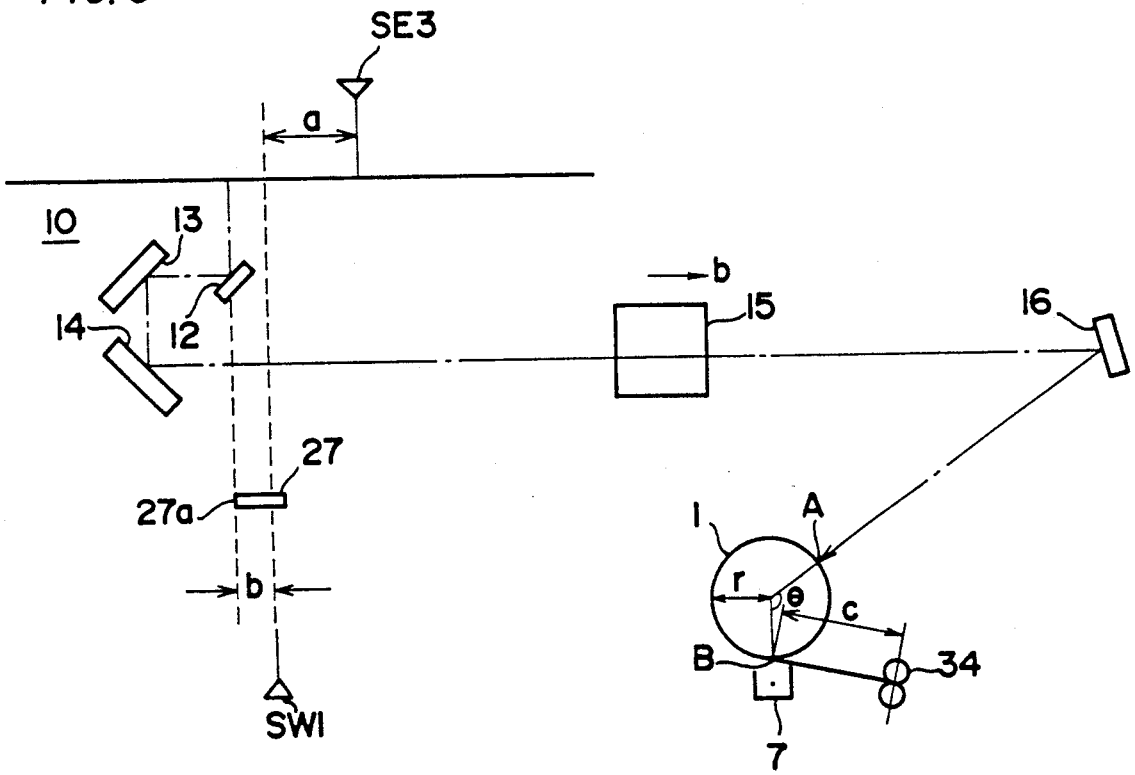
FIG. 3 is a view of explaining the adjustment of the transport of a copy sheet to the transport of an original in the second image scan mode.

In FIG. 3, (a) denotes the distance between the original timing sensor SE3 and the detecting point of the switch SW1, and (b) denotes the distance between the detecting point of the switch SW1 and a position where the optical system 10 overruns and actually stops. The switch SW1 detects the optical system 10 when a detection plate 27 provided with the first slide 20 comes into contact with the actuator of the switch SW1. Accordingly, when an edge 27*a* of the detection plate 27 is at the detecting point of the switch SW1, the optical system 10 is standing by at the standard scan starting position, and the distance (b) is an error of the scan starting position. Also, (c) denotes the distance between the position where the leading edge of a copy sheet is registered by the timing rollers 34 and the transfer point B. The angle $\theta$ is an angle formed of the exposure point A and the transfer point B on the photosensitive drum 1, and (r) denotes the radius of the photosensitive drum 1. The distance (b) is calculated from a count of the encoder pulses generated after the detection plate 27 turns on the switch SW1 at the standard position until the optical system 10 actually stops. The optical system 10 returns toward the standard position after a preliminary scan at the time of starting the power supply, or after an image scan by the movement of the optical system 10 in the first image scan mode.

In an operation in the second image scan mode using the ADF 40, the time T from when the original timing sensor SE3 is turned on until when the copy sheet timing rollers 34 are rotated is calculated as follows. Vp is the system speed.

$$T=\{[(2\pi r\theta / 360)-c] / Vp\}+[(a+b)/ Vp]\ldots \quad (1)$$

The distance (b) operated from the count of the encoder pulses is applied to the equation (1) in order to calculate the time T. The error of the position of the optical system 10 is adjusted by delaying the timing of turning on the copy sheet timing rollers 34 for the time T. Thereby, at the transfer point B, the image can be synchronized with the copy sheet.

Control Circuitry

Figure 4:
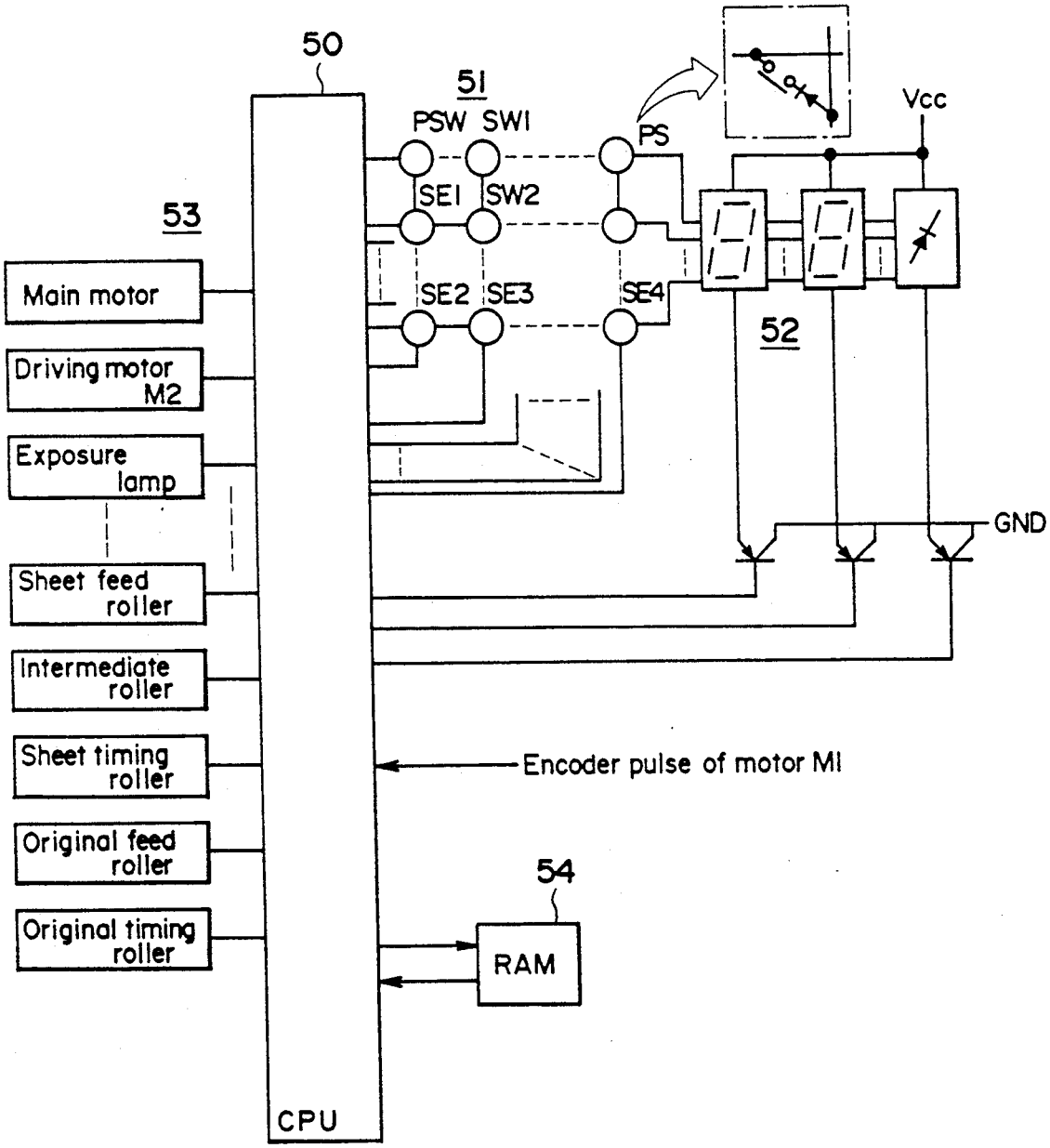
FIG. 4 is a block diagram showing a control circuitry.

A control circuitry of the above-described copying machine is hereinafter explained, referring to FIG. 4.

The control is performed mainly by a microcomputer 50 (which is hereinafter referred to as CPU). The CPU 50 is connected to a switch matrix 51 via an input/output port and to a display section 52 composed of display elements via an output port. The switch matrix 51 comprises a print key switch PSW disposed on the control panel (not shown in the drawings), a ten-key, a density key, the switches SW1, SW2, the sensors PS, SE1 through SE4 and so on. The display section 52 comprises a seven-segment display for indicating the number of copy sets entered with the ten-key and the condition of the machine such as a paper jam, and display elements such as LEDs for indicating the size and the stored volume of copy sheets. The display section 52 is turned on and off in response to signals transmitted from the switch matrix 51 and the CPU 50.

Respective control circuits of the main motor M2, the exposure lamp 11, the optical system driving motor M1 and other rollers are connected with the output section 53 of the CPU 50. A random access memory 54 (which is hereinafter referred to as RAM) is connected to the CPU 50, and the pulse signal generated from the encoder 26 in synchronization with the rotation of the motor M1 is entered into the CPU 50.

Control Procedure

A control procedure of the copying operation performed by the CPU 50 is hereinafter described, referring to FIGS. 5, *6a* and *6b*.

Figure 5:
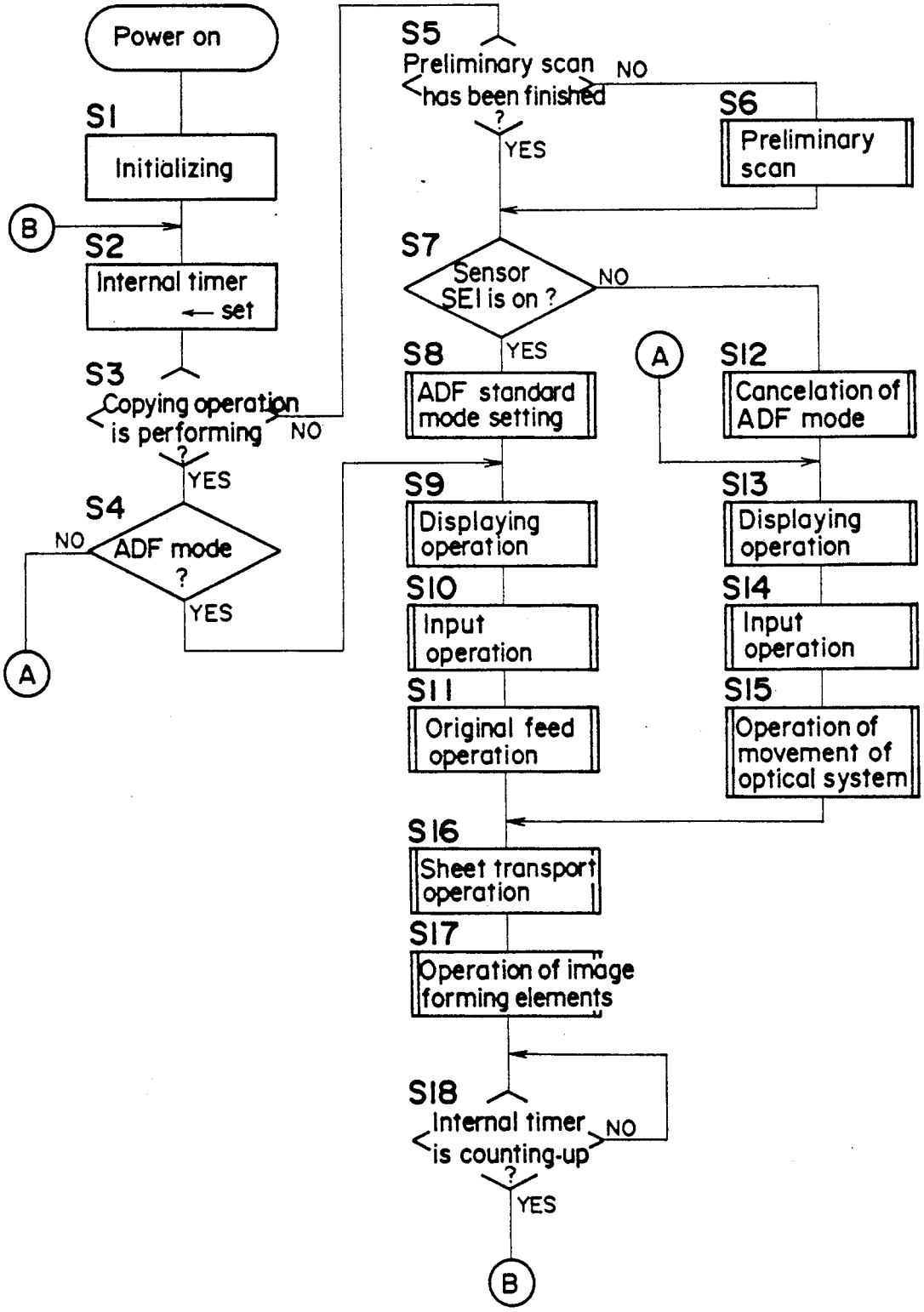
FIG. 5 is a flowchart showing a main routine of a microcomputer.
Figure 6A:
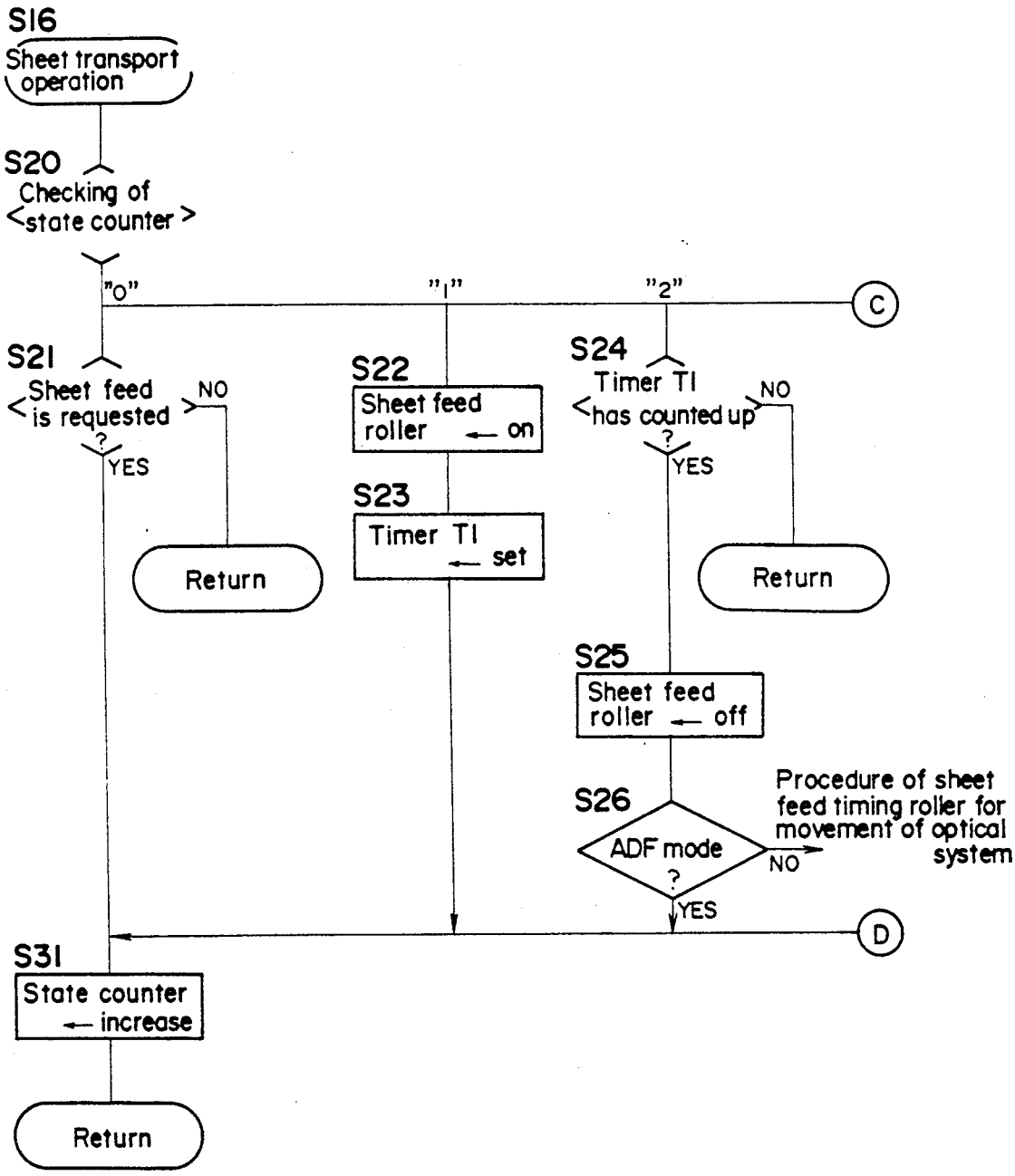
Figure 6B:
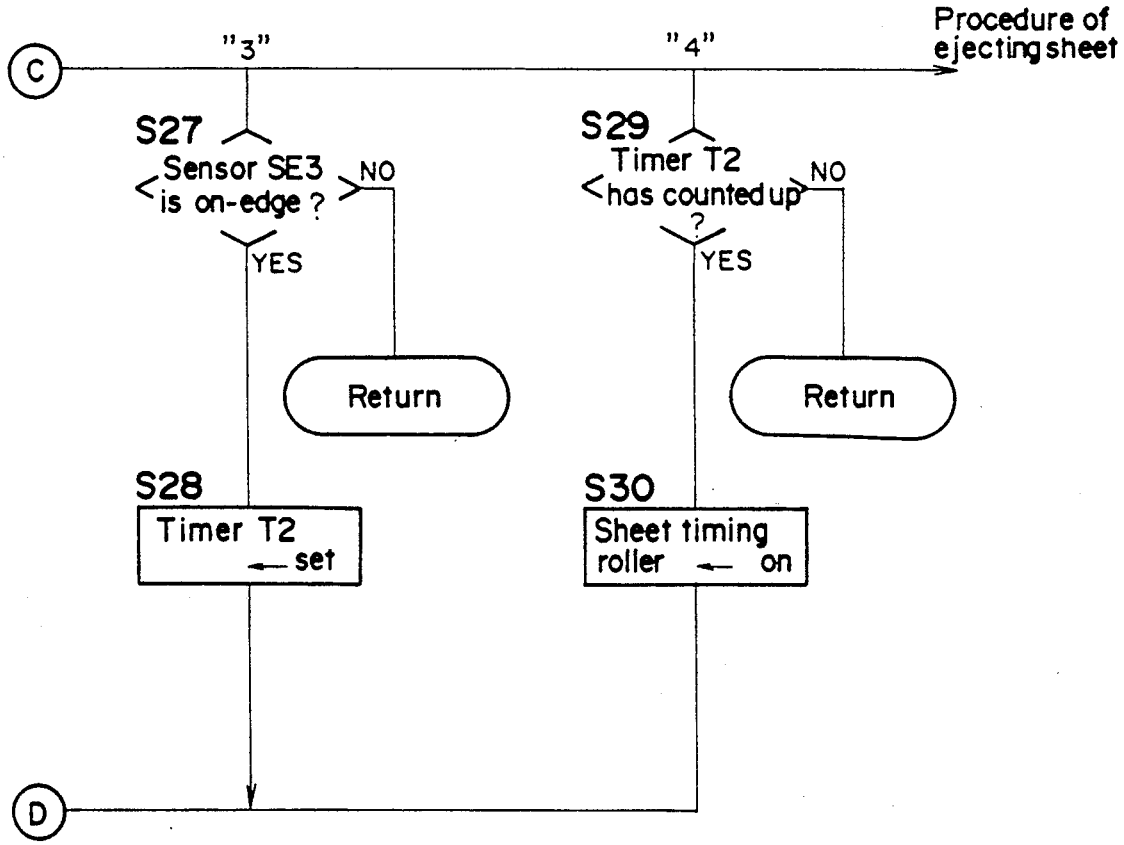

FIG. 5 shows a main routine of the CPU 50.

When the power is supplied, and the program is started, at step S1, the RAM 54, registers, etc. in the CPU 50 are cleared, so that all the changeable items in each device are reset to the initial state. Next, an internal timer for determining a time required for one cycle of the main routine is set at step S2. Each timer in the subroutines is set based on this internal timer.

It is checked at step S3 whether in the middle of a copying operation or not. When it is in the middle of a copying operation, it is checked at step S4 whether the operation mode is the ADF mode, that is, whether it is a copying operation using the ADF 40 or not. When the operation mode is the ADF mode (the second image scan mode), the processing goes to step S9. When it is the ordinary copying mode (the first image scan mode), the processing goes to step S13. When it is judged at step S3 not to be in the middle of a copying operation, the processing goes to step S5 to check whether a preliminary scan has been finished or not. When the preliminary scan has not been finished, the movement of the optical system 10 and the rotation of the photosensitive drum 1 are started for the preliminary scan at step S6. The preliminary scan is performed in a conventional way. In this embodiment, however, when the optical system 10 is returning, the overrun distance (b) is measured by counting pulses generated from the encoder from when the switch SW1 is turned on until when the optical system 10 actually stops. The measured value of the distance (b) is stored in the RAM 54.

After the preliminary scan, it is judged at step S7 whether originals are set on the ADF 40 by checking whether the sensor SE1 is on or off. When the sensor SE1 is on, that is, when originals are set on the ADF 40, the operation mode is set to the ADF mode (the second image scan mode) at step S8. At the same time, copying conditions are settled on the standard mode (the number of copy sets and the magnification are both "1") automatically.

Thereafter, a subroutine for a displaying operation in the display section 52, a subroutine for an input operation according to the turning-on of the print key switch PSW and a subroutine for an original feed operation by the ADF 40 are executed at steps S9, S10 and S11 respectively. Further, a copy sheet transport operation from the supply to the ejection is performed at step S16, and the image forming elements disposed around the photosensitive drum 1 are operated at step S17.

On the other hand, when the sensor SE1 is judged off at step S7, that is, when no originals are set on the ADF 40, the ADF mode is canceled and the ordinary copy mode (the first image scan mode) is set at step S12. Next, at steps S13 and S14, the similar display operation and input operation to steps S9 and S10 are performed, and the optical system 10 is moved at step S15. The movement of the optical system 10 is performed in a conventional way. In this embodiment, however, the overrun distance (b) is measured and the value is stored in the RAM 54, the same as the operation at step S6.

When all the subroutines are finished, the processing waits for the counting-up of the internal timer at step S18, and then returns to step S2.

FIGS. *6a* and *6b* show a subroutine for a copy sheet transport operation executed at step S16 in the main routine. Especially, they show the procedure of turning on the timing rollers 34.

In the subroutine, first, a state counter is checked at step S20, and the following processing is executed according to the counter value.

When the state counter is reset at "0", it is checked whether a copy sheet is requested to be fed. When a copy sheet is not requested, the processing returns to the main routine immediately. When a copy sheet is requested, the state counter is set to "1" at step S31.

When the state counter is "1", the copy sheet feed roller 32 is turned on at step S22, and a timer T1 is set at step S23. Then, the state counter is set to "2" at step S31. The timer T1 determines how long the feed roller 32 is rotated, and a fixed value is set into the timer T1 at all times.

When the state counter is "2", it is confirmed at step S24 that the timer T1 has counted up, and the feed roller 32 is turned off at step S25. Next, it is checked at step S26 whether in the middle of an operation in the ADF mode or not. When the operation is in the ADF mode, the state counter is set to "3" at step S31. When it is not in the ADF mode, the processing follows a procedure of turning on the copy sheet timing rollers 34 for a scan performed by the movement of the optical system 10 in order to execute a copying operation in the first image scan mode. Further, this kind of procedure is so well-known that the detailed description is omitted.

When the state counter is "3", it is checked at step S27 whether the original timing sensor SE3 is on-edge or not, that is, whether the sensor SE3 has changed from off to on because the leading edge of an original has reached the detecting point of the sensor SE3. When it is on-edge, a timer T2 is set at step S28, and the state counter is set to "4" at step S31. At step S6 or S15, the overrun distance (b) of the optical system 10 is measured, and the time T is calculated from the equation (1), the overrun distance (b) being a parameter. The calculated time T, which is required for delaying turning on the copy sheet timing rollers 34 is set into the timer T2. Accordingly, the time T is changeable in accordance with the overrun distance (b) of the optical system 10.

When the state counter is "4", it is confirmed at step S29 that the timer T2 has counted up. Then, the copy sheet timing rollers 34 are turned on at step S30, and the state counter is set to "5" at step S31. In turning on the timing rollers 34, the timing of feeding a copy sheet to the transfer point B is adjusted to the overrun distance (b) of the optical system 10, and thereby the synchronization of the image with the copy sheet can be regulated properly.

Further, after the state counter is set to "5", the processing follows a procedure of ejecting the copy sheet which has got an image onto the tray 38. The procedure is so well-known that the detailed description is omitted.

Although the present invention has been described in connection with the preferred embodiment thereof, it is to be noted that various changes and modification are apparent to those who are skilled in the art. Such changes and modification are to be understood as included within the scope of the present invention as defined by the appended claims, unless they depart therefrom.

What is claimed is:

1. A copying apparatus for copying an original image onto a copy sheet, comprising:
- an original table for supporting an original;
- optical means for scanning the original on said original table and projecting the image onto a photosensitive member;
- drive means for moving said optical means;
- means for transporting the original in one direction on said original table;
- control means for operating said optical means and said original transport means either in a first image scan mode wherein a scan of an original at a standstill on said original table is performed by the movement of said optical means and the image is projected onto said photosensitive member, or in a second image scan mode wherein said optical means standing by at a specified position scans an original being transported by said original transport means and the image is projected onto said photosensitive member;
- means for measuring distance between a position where said optical means actually stops and the specified position where said optical means is supposed to stop; and
- means for adjusting the transport of an original and the supply of a copy sheet to synchronize them according to the distance measured by said measuring means during an operation in the second scan mode.

2. A copying apparatus as claimed in claim 1, wherein the specified position where said optical means stands by in the second image scan mode is a position where the optical means starts moving in the first image scan mode.

3. A copying apparatus for copying an original image onto a copy sheet, comprising:
- an original table for supporting an original;
- optical means for scanning the original on said original table and projecting the image onto a photosensitive member;
- drive means for moving said optical means;
- means for transporting an original in one direction on said original table;
- control means for operating said optical means and said original transport means either in a first image scan mode wherein a scan of an original at a standstill on said original table is performed by the movement of said optical means and the image is projected onto said photosensitive member, or in a second image scan mode wherein said optical means standing by at a specified position scans an original being transported by said original transport means and the image is projected onto said photosensitive member;
- means for detecting said optical means reaching a standard starting position;
- means for measuring a gap between a position where optical means actually stops and the standard starting position; and
- means for adjusting the transport of an original and the supply of a copy sheet to synchronize them according to the gap measured by said measuring means during an operation in the second image scan mode.

4. A copying apparatus for copying an original image onto a copy sheet, comprising:
- an original table for supporting an original;
- optical means for scanning the original on said original table and projecting the image onto a photosensitive member;
- drive means for moving said optical means;
- an original tray for holding originals;
- means for taking the originals out of said original tray one by one automatically and transporting each original in one direction on said original table;
- control means for operating said optical means and said original transport means either in a first image scan mode wherein a scan of an original at a standstill on said original table is performed by the movement of said optical means and the image is projected onto said photosensitive member, or in a second image scan mode wherein said optical means standing by at a specified position scans an original being transported by said original transport means and the image is projected onto said photosensitive member;
- means for detecting the originals set on said original tray; and
- means for setting the second image scan mode and setting copying conditions to specified ones when originals on said original tray are detected by said detecting means, wherein the position where said optical means is stationary during a scan in the second image scan mode is a position where the optical means starts moving for a scan of an original in the first image scan mode.

5. A copying apparatus as claimed in claim 4, wherein the number of copy sets is one of said copying conditions, and said setting means designates "1" as the number of copy sets.

6. A copying machine as claimed in claim 4, wherein the magnification is one of said copying conditions, and said setting means designates "1" as the magnification rate.

7. A copying apparatus for copying an original image onto a copy sheet, comprising:

optical means for scanning an original and projecting the image onto a photosensitive member;

drive means for moving said optical means in order to scan an original which is at a standstill;

original-moved scanning means wherein said optical means at a standstill at a specified position scans an original moving on one direction;

means for measuring distance between a position where said optical means actually stops after being moved by said drive means and the specified position where said optical means is supposed to stop; and means for adjusting the transport of an original and the supply of a copy sheet to synchronize them according to the distance measured by said measuring means during an operation of said original-moved scanning means.

8. A copying apparatus for copying an original image onto a copy sheet, comprising:

an original table for supporting an original;

optical means for scanning the original on said original table and projecting the image onto a photosensitive member;

drive means for moving said optical means to scan the original at a standstill on said original table so that the image is projected onto the photosensitive member;

means for detecting said optical means in the neighborhood of a standard starting position in order to make said optical means moved by said drive means come to a standstill at a specified position and for detecting a value representing the difference between the standard starting position and the specified position;

means for transporting an original in one direction on said original table;

means for setting an original-moved scanning mode wherein said optical means at a standstill at the specified position scans an original being transported by said original transport means and the image is projected onto the photosensitive member;

means for transporting a copy sheet at a specified timing in accordance with the travel of the original during an operation in the original-moved scanning mode; and means for adjusting the specified timing in accordance with the value detected by said detecting means.

9. A method of copying an original image onto a copy sheet, comprising steps of:

moving optical means along an original table;

stopping said optical means at a specified position after the movement;

detecting a position where said optical means actually comes to a standstill;

performing a scan of an original being transported by original transport means in one direction by said optical means which is at a standstill and projecting the image onto a photosensitive member; and transporting a copy sheet at a specified timing according to the detected position where said optical means comes to a standstill.

* * * * *

UNITED STATES PATENT AND TRADEMARK OFFICE

CERTIFICATE OF CORRECTION

PATENT NO. : 5,029,315

DATED : July 2, 1991

INVENTOR(S) : Takeshi MORIKAWA, et al.

It is certified that error appears in the above-identified patent and that said Letters Patent is hereby corrected as shown below:

Column 11:
In claim 7, line 9 (column 11, line 9), change "on" to --in--.

Signed and Sealed this

Twenty-ninth Day of September, 1992

*Attest:*

DOUGLAS B. COMER

*Attesting Officer*

*Acting Commissioner of Patents and Trademarks*